US005100013A

United States Patent [19]

Strassheimer

[11] Patent Number: 5,100,013

[45] Date of Patent: * Mar. 31, 1992

[54] PLASTIC CLOSURE

[75] Inventor: Herbert Strassheimer, Windermere, Fla.

[73] Assignee: Extrudiplast Investments, S.A., Geneva, Switzerland

[ * ] Notice: The portion of the term of this patent subsequent to Jun. 4, 2008 has been disclaimed.

[21] Appl. No.: 637,707

[22] Filed: Jan. 9, 1991

Related U.S. Application Data

[63] Continuation of Ser. No. 471,644, Jan. 29, 1990, Pat. No. 5,020,683.

[51] Int. Cl.[5] ..... B65D 41/00

[52] U.S. Cl. ..... 215/354

[58] Field of Search ..... 215/342, 344, 345, 354, 215/356

[56] References Cited

U.S. PATENT DOCUMENTS 3,433,380 3/1969 Kawchitch ..... 215/329

3,482,725 12/1969 Exton ..... 215/354 X

*Primary Examiner*—Stephen Marcus

*Assistant Examiner*—Nova Stucker

*Attorney, Agent, or Firm*—Bachman & LaPointe

[57] ABSTRACT

The closure includes a bottle cap having a thread on the inner surface of the side wall and a hollow plastic container having an open neck end including a lip region with an outer threaded wall portion extending downwardly therefrom and engagable with the thread on the cap. The lip region includes tapered portions engagable with corresponding tapers on the cap with the lip region placed under stress against the cap.

5 Claims, 1 Drawing Sheet

PLASTIC CLOSURE

This is a continuation, of application Ser. No. 471,644 filed Jan. 29, 1990 now U.S. Pat. No. 5,020,683.

BACKGROUND OF THE INVENTION

The present invention relates to threaded plastic bottles, especially polyethylene terephthalate, and closures therefor especially useful for carbonated beverages. The bottle-closure combination requires simple construction and the assurance of proper sealing. This is especially important where carbonated beverages are involved. In addition, the re-sealing operation must be simple to perform and also assure proper sealing.

A resilient ring or gasket is frequently placed between the rim of the container and the engaging surface of the cap in order to effect a pressure tight seal. However, with frequent use the gasket often deteriorates or is inadvertently discarded. Other designs are subject to disadvantages. Complex rim configurations are often difficult to use or are subject to foreign material becoming embedded in the rim. Also, complex collar designs often become damaged as during stacking in shipment.

It is therefore a principal object of the present invention to provide a plastic closure for use with a deformable container which is simple in construction and easy and convenient to use.

It is a further object of the present invention to provide a plastic closure which effectively obtains sealing of internal bottle pressure or carbonation even after repeated use.

It is a still further object of the present invention to provide a plastic closure which is not based on complex design features.

Further objects and advantages of the present invention will appear hereinbelow.

SUMMARY OF THE INVENTION

The foregoing objects and advantages are obtained in accordance with the present invention. The plastic closure of the present invention for use with a deformable container comprises: a bottle cap having a top wall, a cylindrical side wall depending from the top wall and a thread on the inner surface of the side wall; a hollow plastic container having an open neck end including a lip region and extending downwardly therefrom an outer threaded wall portion engagable with the thread on the cap; an inwardly facing first taper on the lip region engagable with a corresponding mating first taper on the bottle cap and an outwardly facing second taper on the lip region engagable with a corresponding mating second taper on the bottle cap; wherein the second taper on the bottle cap is greater than the second taper on the lip region suitable to inwardly deform the lip region and to stress the first lip taper against the first cap taper.

The container has an open neck end, a body region depending from the neck and a closed end depending from the body region. The open neck includes an inner wall portion opposed to the outer threaded wall portion extending downwardly from the lip region.

Preferably the first lip taper is 10°–40°, the second lip taper is 2°–10° and the second cap taper is 0.2°–1° greater than the second lip taper.

The cap preferably includes a downwardly facing groove having an inner and outer surface, with a downwardly extending flange portion forming the inner surface of said groove and the first cap taper, and the outer surface of said groove forming the second cap taper and having the cap threads extending downwardly therefrom.

Further features of the present invention will appear hereinbelow.

BRIEF DESCRIPTION OF THE DRAWINGS

The features and advantages of the present invention will be more readily understandable from a consideration of the accompanying drawings wherein.

DETAILED DESCRIPTION

Figure 1:
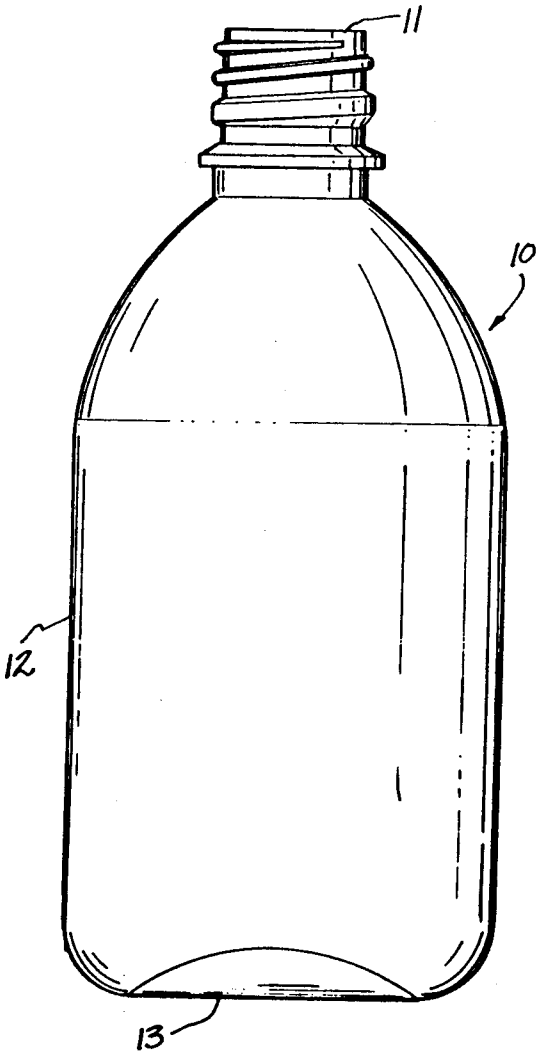
FIG. 1 is a side view of a representative hollow plastic container.

FIG. 1 shows a representative hollow plastic container 10 having an open neck region 11, a body region 12 depending from the neck and a closed end portion 13 depending from the body portion. The particular configuration shown in FIG. 1 is for purposes of illustration only and any desired configuration for a hollow plastic container may readily be employed. In the preferred embodiment, the present invention has particular application to hollow plastic containers used for carbonated beverages made of polyethylene terephthalate (PET) although other plastic materials and other applications may be employed.

Figure 2:
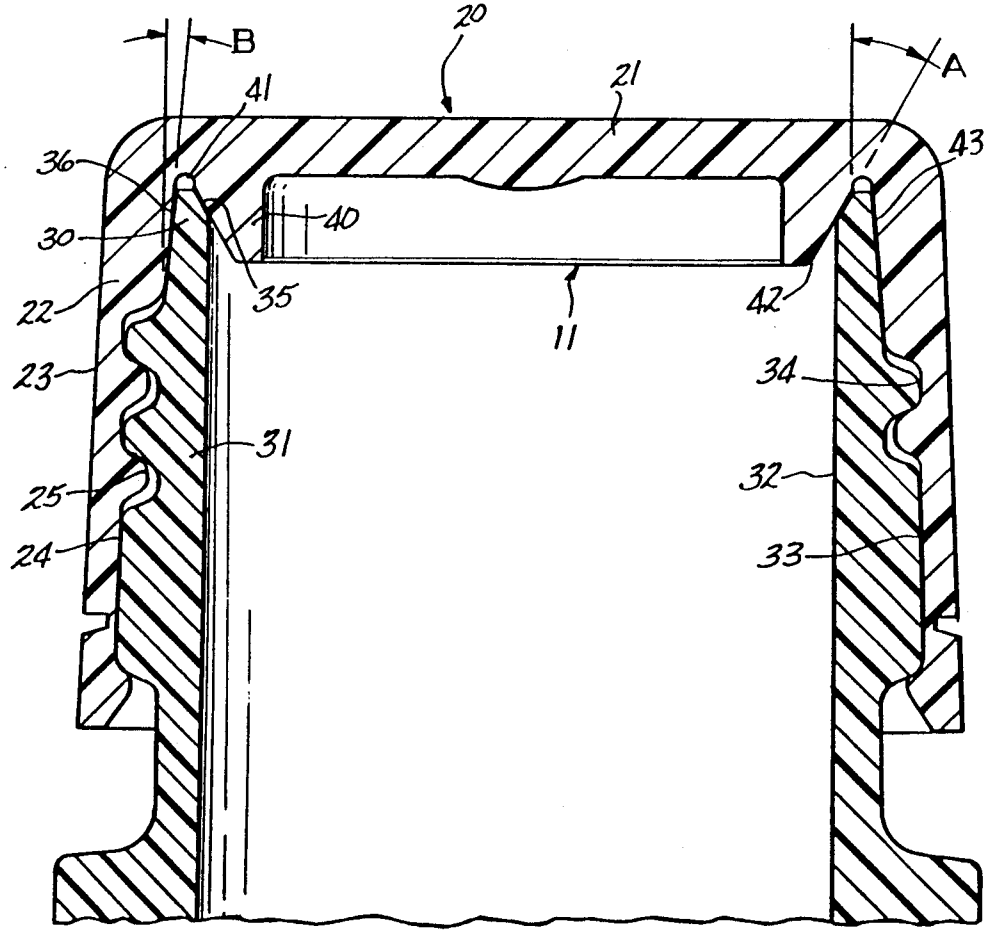
FIG. 2 is a sectional view on an enlarged scale of the neck region of the container with closure applied thereto.

Referring to the enlarged, detailed sectional view of FIG. 2, bottle cap 20 is provided for closing the open neck 11 of container 10. The preferred material for the bottle cap is PET since it is desirable to make the cap from the same material as the container from the standpoint of recycling. However, from a standpoint of function other materials may readily be used, such as other plastic materials.

Cap 20 has a top wall 21 and a cylindrical side wall 22 depending from the top wall. Side wall 22 has a substantially planar outer wall 23 and an inner wall 24 facing the container neck region 11, with inner wall 24 being provided with threads 25 thereon.

Container neck region 11 includes a lip or rim region 30 and cylindrical side wall 31 depending from the lip region. Container neck region side wall 31 has a substantially planar inner wall 32 facing the interior of the neck region and an outer wall 33, with the outer wall 33 being provided with threads 34 engagable with threads 25 on the bottle cap 20. Thus, the container and cap have mutually engaging threads for opening and closing the container.

Lip region 30 is provided with an inwardly facing first taper 35 and an outwardly facing second taper 36. The angle A of the first taper from the vertical is preferably about 30°, although the particular angle is not critical and any acute angle may be employed with angles of for example about 10°–40° being readily usable. The angle B of the second taper from the vertical must be smaller than the first taper, for example, the angle B of the second taper is preferably about 5°. Generally the angles for the second taper should range from about 2°–10°.

Cap 20 is provided with a downwardly extending flange 40 depending from top wall 21 and spaced inwardly from side wall 22 forming a downwardly extending groove 41. Flange 40 has an outwardly facing first taper 42 corresponding to and engagable with first lip taper 35. Cap side wall 22 has an inwardly facing second taper 43 mating with second lip taper 36. Thus, the inner surface of groove 41 is formed by the first cap taper 42 and the outer surface of groove 41 is formed by the second cap taper 43.

In accordance with the present invention, the second cap taper 43 is greater than the second lip taper 36 so that the lip region 30 is inwardly deformed and so that the first lip taper 35 is stressed against the first cap taper 42. Generally the second cap taper 43 is slightly greater than the second lip taper 36. The preferred differential is about 0.5° and generally from about 0.2°-1°.

Thus, in use the cap is screwed on to seat against the first tapered seating surface at the inside top of the bottle neck. At the same time the above mentioned second tapers engage, except for their small difference of about 0.5 in the preferred embodiment. When the screwing action is continued the larger second cap taper will cause radial inwardly directed force to be exerted against the container neck, deforming it into increased engagement at the cap flange or seat 40. The corresponding pre-stress force is greater than the internal container pressure can overcome and therefore the integrity of the seal is preserved. Moreover, the container can be repeatedly opened and closed in this manner while preserving the integrity of the seal.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hollow plastic container adapted to be closed by a closure, which comprises: an open neck region; a body region depending from the neck; a closed end depending from the body; wherein said neck region includes a lip or rim region having a cylindrical side wall depending therefrom and defining a substantially planar inner wall and an outer wall; said lip region defining surfaces comprising an inwardly facing first taper and an outwardly facing second taper, said tapered surfaces adapted to engage with a closure and form a seal therewith; and wherein said tapered surfaces are adapted to engage corresponding tapered surfaces of a closure to inwardly deform the lip region and stress the lip region against the closure.

2. A container according to claim 1 wherein said plastic is polyethylene terephthalate.

3. A container according to claim 1 wherein said outer wall is threaded.

4. A container according to claim 1 wherein said first taper is 10°-40°.

5. A container according to claim 4 wherein said second taper is smaller than the first taper and is from 2°-10°.

* * * * *